US005158485A

United States Patent [19]

Saito et al.

[11] Patent Number: 5,158,485

[45] Date of Patent: Oct. 27, 1992

[54] FEMALE SOCKET CONTACT

[75] Inventors: Hitoshi Saito; Osamu Sugiyama; Masutoshi Hashimoto; Kazuo Nagata, all of Shizuoka, Japan

[73] Assignee: Yazaki Corporation, Japan

[21] Appl. No.: 658,331

[22] Filed: Feb. 20, 1991

[30] Foreign Application Priority Data

Feb. 21, 1990 [JP] Japan ..... 2-15629[U]

[51] Int. Cl.[5] ..... H01R 13/62

[52] U.S. Cl. ..... 439/843; 439/851

[58] Field of Search ..... 439/842–850, 439/852, 853, 858, 851

[56] References Cited

U.S. PATENT DOCUMENTS

| | | | |
|---|---|---|---|
| 2,814,025 | 11/1957 | Wade et al. | 439/845 |
| 3,120,989 | 2/1964 | Solorow et al. | 439/843 |
| 3,370,265 | 2/1968 | Berg | 439/843 |
| 3,383,645 | 5/1968 | Milanese et al. . | |
| 3,705,376 | 12/1972 | Kinkaid et al. . | |
| 3,781,760 | 12/1973 | Mancini et al. . | |
| 3,845,451 | 10/1974 | Neidecker | 439/845 |
| 4,168,878 | 9/1979 | Risser et al. . | |
| 4,734,064 | 3/1988 | Knapp et al. . | |
| 4,880,401 | 11/1989 | Shima et al. . | |

FOREIGN PATENT DOCUMENTS

| | | |
|---|---|---|
| 1615718 | 9/1971 | Fed. Rep. of Germany . |
| 2057313 | 5/1972 | Fed. Rep. of Germany . |
| 1811276 | 3/1974 | Fed. Rep. of Germany . |
| 999817 | 7/1965 | United Kingdom . |

OTHER PUBLICATIONS

Japanese Utility Model Publication (Kokai) No. 135692/79, issued Sep. 20, 1979.

Japanese Utility Model Publication (Kokai) No. 78587/85, issued May 31, 1985.

Japanese Utility Model Publication (Kokai) No. 12169/88, issued Jan. 26, 1988.

Japanese Patent Publication (Kokai) No. 135191/74, issued Dec. 26, 1974.

Japanese Patent Publication (Kokai) No. 37790/80, issued Mar. 15, 1980.

Japanese Patent Publication (Kokai) No. 111082/80, issued Aug. 27, 1980.

*Primary Examiner*—David L. Pirlot

*Attorney, Agent, or Firm*—Venable, Baetjer, Howard & Civiletti

[57] ABSTRACT

Disclosed is a female socket contact of the type having a female electrical contact section adapted to mate with a corresponding male contact and a resilient contact plate provided in the female electrical contact section. Thin-walled sections are respectively formed in opposing side walls constituting the female electrical contact section so as to provide on the respective inner surfaces of the side walls recesses for inner-space enlargement, and the end edges of the resilient contact plate are respectively positioned in the recesses for inner-space enlargement, thereby providing a large resilient contact pressure.

3 Claims, 2 Drawing Sheets

FEMALE SOCKET CONTACT

BACKGROUND OF THE INVENTION

1. Field of the Invention

This invention relates to a male and a female contact used for connecting wire harnesses and, in particular, to an improvement in a female socket contact.

2. Description of the Related Art

A known female socket contact has a wire connection section and a box-type or a cylinder-type female electrical contact section which is adapted to mate with a corresponding male contact. Provided in the female electrical contact section is a resilient contact plate formed of a highly resilient metal different from the material of this section. The resilient contact plate has at each side end of its base portion an engagement section, which respectively engages an engagement hole provided in each side wall of the electrical contact section.

In the above structure, the resilient contact plate is formed in such a width as will allow it to be positioned between the two side walls of the female electrical contact section. That is, the width of the resilient contact plate is smaller than that of the electrical contact section by the thickness of the side walls and the clearance between this resilient contact plate and the side walls. Thus, the width of the resilient contact plate in the above structure is restricted as compared with that of the electrical contact section. This makes it difficult to obtain a large resilient contact pressure.

SUMMARY OF THE INVENTION

This invention has been made in view of the problem mentioned above. It is accordingly an object of this invention to provide a female socket contact in which the resilient contact plate in the electrical contact section has a relatively large width, thereby improving the performance of the resilient contact plate.

In order to achieve the above object, this invention provides a female socket contact comprising a female electrical contact section having opposing side walls and adapted to mate with a corresponding male contact, and a resilient contact plate provided in the female electrical contact section and having end edges, the female electrical contact section having thin-walled sections respectively formed in the opposing side walls thereof, the above-mentioned thin-walled sections respectively providing in the side walls recesses for inner-space enlargement, and the end edges of the resilient contact plate being respectively positioned in the above-mentioned recesses for inner-space enlargement.

In the structure of this invention described above, the resilient contact plate of the female socket contact can be made as large as possible within the limited space of the female electrical contact section, so that a large resilient contact pressure can be obtained. With its thin-walled sections left in the side walls, this socket contact structure can provide a sufficient level of strength.

Further advantages of this invention will be better understood from the following detailed description with reference to the accompanying drawings.

DESCRIPTION OF THE PREFERRED EMBODIMENT

Figure 1:
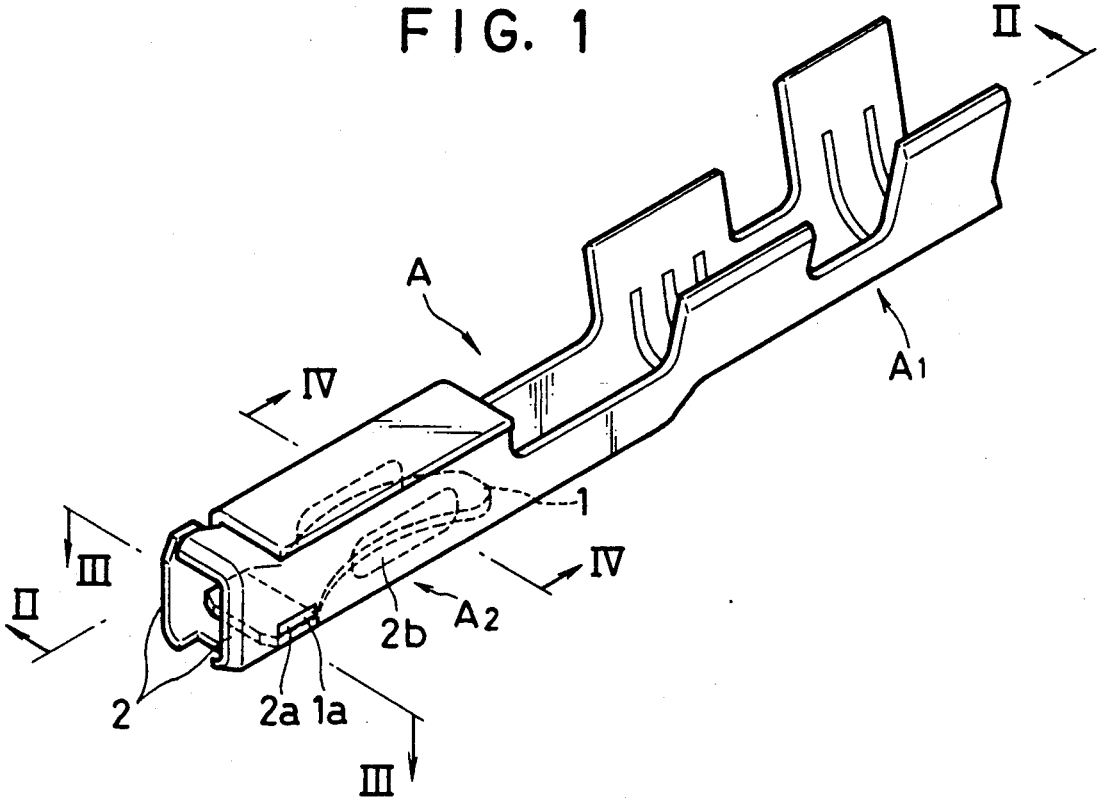
FIG. 1 is a perspective view of a socket contact in accordance with an embodiment of this invention.
Figure 2:
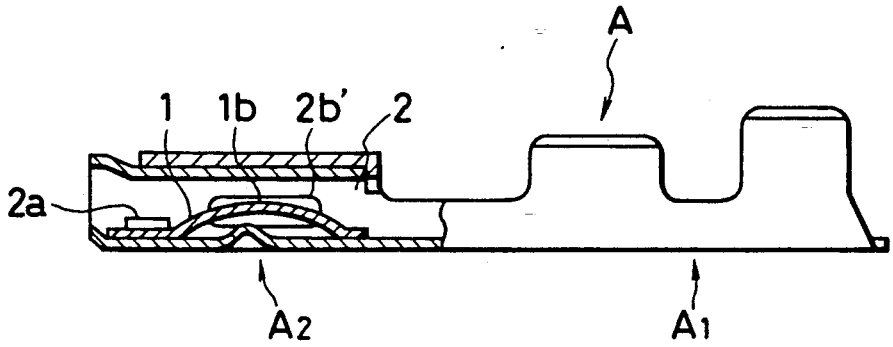
FIG. 2 is a sectional view taken along the line II—II of FIG. 1.

Referring to FIGS. 1 and 2, the socket contact A shown has a wire connection section A and a female electrical contact section A2 adapted to mate with a corresponding male contact having a flat configuration. The female electrical contact section A2 has a box-type body with its forward end open, in which is provided a resilient contact plate 1 formed of a highly resilient metal different from the material of this electrical contact section. The box-type body has opposing side-walls 2 that have substantially flat exterior surfaces. The base portion of the resilient contact plate 1 has an engagement section 1*a* at each side end thereof, and these engagement sections 1*a* are respectively engaged with engagement holes 2*a* respectively formed in the side walls 2 constituting the female electrical contact section A2.

Figure 4:
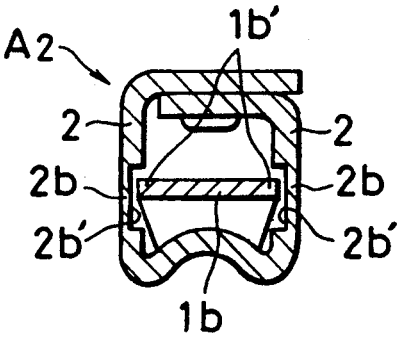
FIG. 4 is a sectional view taken along the line IV—IV of FIG. 1.

As shown in FIG. 4, formed by press work in the respective middle sections as measured in the vertical direction of the side walls 2 are thin-walled sections 2*b* extending in the longitudinal direction, which thin-walled sections 2*b* provide on the respective inner surfaces of the side walls 2 recesses 2*b*' for inner-space enlargement.

Figure 3:
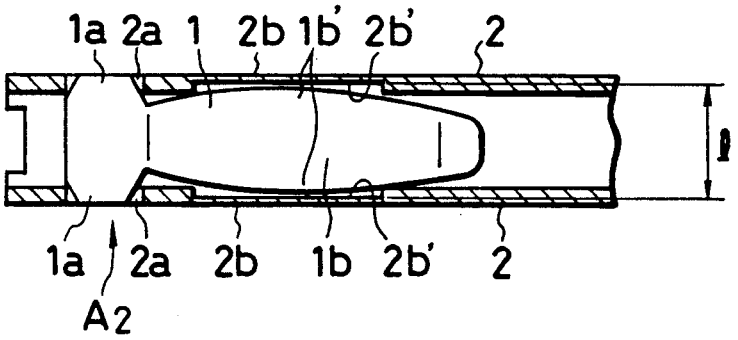
FIG. 3 is a sectional view taken along the line III—III of FIG. 1.

The width l of the main plate section 1*b* of the resilient contact plate 1 is such that it extends over the distance between the bottoms of the recesses 2*b*', with the respective end edges 1*b*' of the main plate section 1*b* being respectively positioned in the recesses 2*b*' for inner-space enlargement in such a manner as to be resiliently displaceable. Thus, as shown in FIG. 3, the width l of the main plate section 1*b* can be made relatively large with respect to the width of the female electrical contact section A2.

What is claimed is:

1. A female socket contact comprising a female electrical contact body having opposing side walls and adapted to mate with a corresponding male contact, and a resilient contact plate provided in said female electrical contact body and having two opposing side edges, wherein each said side wall of said female electrical contact body has a thin-walled section that defines a recess on an inner surface of the side wall such that the inner space of said contact body is enlarged in a region near the recesses and the exterior surface of each said side wall is substantially flat;

wherein a portion of said side edges of said resilient contact plate are positioned in respective ones of said recesses;

wherein said contact plate has an enlarged width between said portions of said side edges positioned in respective said recesses; and wherein each of said side walls has an engagement hole, and each of said side edges of said resilient contact plate has a corresponding engagement section received in a respective one of said engagement holes.

2. A female socket according to claim 1, wherein said contact body is an elongated member having a longitudinal axis, and each said side wall extends in a vertical plane substantially perpendicular to said longitudinal axis and wherein each said thin-walled section is formed by press work in the middle of a vertical length of a respective side wall and extends in a longitudinal direction.

3. A female socket contact comprising a wire connection section and a female electrical contact section adapted to mate with a corresponding male contact, wherein said female electrical contact section includes a box-like body having opposing side walls and a resilient contact plate provided in said body and having side edges, wherein said opposing side walls of said body of said female electrical contact section each has a thin-walled section that defines a recess on an inner surface of the side wall such that the inner space of said body is enlarged in a region near the recesses and the exterior surface of each said side wall is substantially flat;

wherein said side edges of said resilient contact plate are positioned in respective of said recesses;

wherein said contact plate has an enlarged width between said portions of said side edges positioned in respective said recesses; and wherein each of said side walls has an engagement hole, and each of said side edges of said resilient contact plate has a corresponding engagement section received in a respective one of said engagement holes.

* * * * *